United States Patent [19]

Lapi

[11] 3,979,929

[45] Sept. 14, 1976

[54] CLOTHING ARTICLE OR THE LIKE EMPLOYING CROCHETED MATERIAL

[75] Inventor: Angeline Lapi, Sprakers, N.Y.

[73] Assignee: The Raymond Lee Organization, Inc., a part interest

[22] Filed: Apr. 2, 1975

[21] Appl. No.: 564,626

[52] U.S. Cl. ..... 66/170

[51] Int. Cl.[2] ..... D04B 1/00

[58] Field of Search ..... 66/1, 169, 170, 171, 66/116, 117

[56] References Cited

UNITED STATES PATENTS

| | | | |
|---|---|---|---|
| 2,299,950 | 10/1942 | Gebhart | 66/170 X |
| 3,228,212 | 1/1966 | Huber | 66/117 |

*Primary Examiner*—Ronald Feldbaum

[57] ABSTRACT

An article of clothing or the like employing crocheted material which is completely reversible. The material has a pattern which employs a succession of arrangements employing a strand of yarn. The strand has a loop and a first extension. The first extension passes to the right of the loop over the periphery thread and a single crochet stitch is formed at the end thereof. The first extension then turns back upon itself to form a second extension. The second extension passes rearwardly under the periphery of the loop and then forwardly over the periphery of the loop and underneath the rearwardly passing portion of the second extension to pass over the first extension. A crochet single stitch is formed at the end of each extension.

7 Claims, 10 Drawing Figures

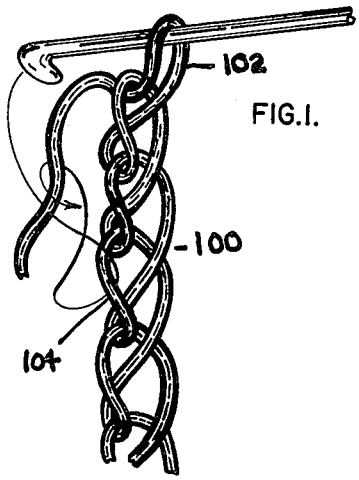
FIG.1.
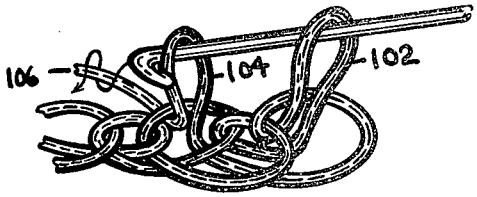
FIG.2.
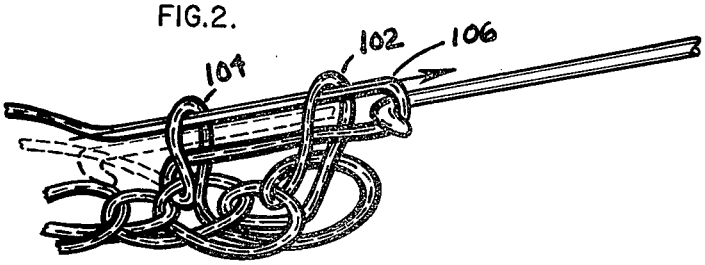
FIG.3.
FIG.4.
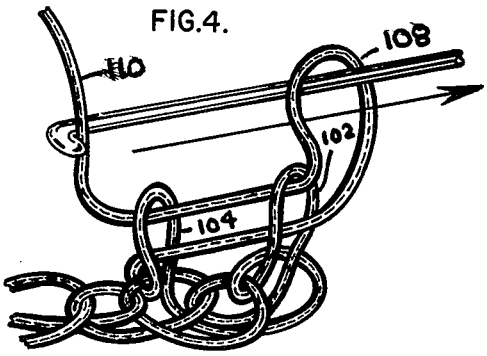
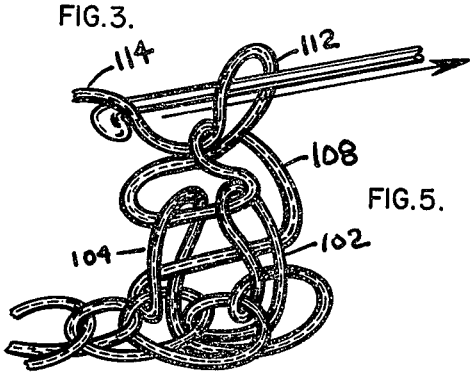
FIG.5.
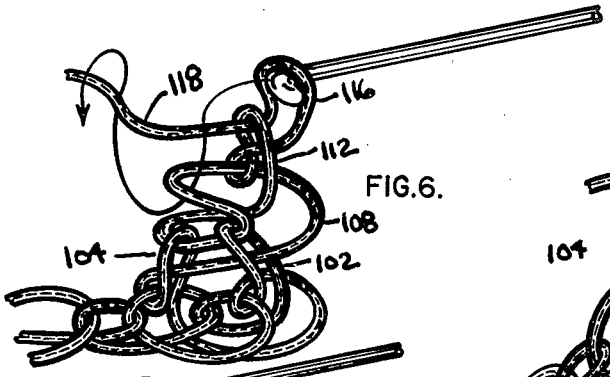
FIG.6.
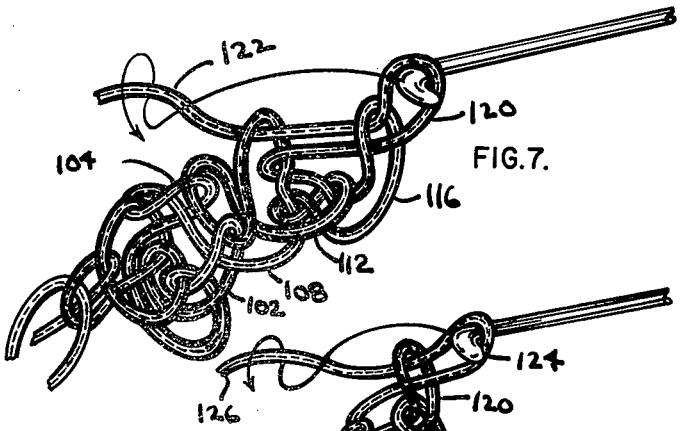
FIG.7.
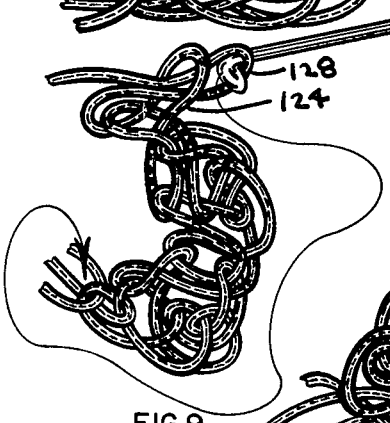
FIG.9.
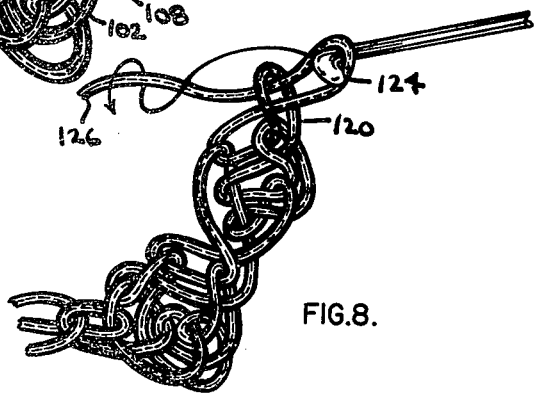
FIG.8.
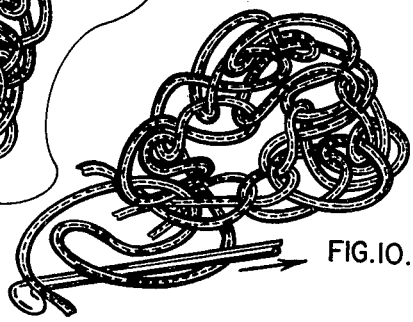
FIG.10.

CLOTHING ARTICLE OR THE LIKE EMPLOYING CROCHETED MATERIAL

SUMMARY OF THE INVENTION

This invention is directed toward a new type of crochet pattern as formed in crocheted material. This pattern is strong, durable, attractive in appearance and easily constructed. Moreover, the pattern is exactly the same in appearance on either side of the crocheted material; it has no "wrong" side. As a result, garments formed from crocheted material in accordance with this invention are completely reversible.

To this end, the pattern is formed from a single strand of yarn using a succession of arrangements which are continually repeated. In each arrangement, a loop is formed on the strand. A first extension of the strand passes to the right of the loop and then at least one crochet single stitch is formed at the end thereof. The yarn strand is then turned back upon itself to form a second extension which passes rearwardly under the periphery of the loop and then forwardly over the periphery of the loop to pass over the first extension. At least one crochet single stitch is formed at the end of the second extension. This process is repeated with a succession of loops as described in more detail below. After each crocheted row is formed, the crochet needle is removed and turned around and the next row is formed, the next row being connected in every single crochet of the last row whereby the reversibility feature is achieved.

BRIEF DESCRIPTION OF THE DRAWINGS

FIG. 1 illustrates the first step of producing the article.

FIGS. 2, 3, 4, 5, 6, 7, 8, 9 and 10 illustrate the various steps in producing the arrangement used repetitively to form the pattern.

DETAILED DESCRIPTION OF PREFERRED EMBODIMENTS

Reference is now made to FIGS. 1–10.

A length of yarn is formed into a crochet chain of loops shown generally at 100 in FIG. 1. A needle is passed through the last loop 102 in the chain to pick up a preceding loop 104 in the chain. The needle having passed through loops 104 and 102 as shown in FIG. 2 picks up yarn length 106 adjacent loop 104 as shown in FIG. 3. This length 106 is formed into loop 108 as shown in FIG. 4. Yarn length 110 is then picked and pulled through loop 108 to form loop 112 as shown in FIG. 5. Yarn length 110 is then picked and is pulled through loop 112 to form loop 116 as shown in FIG. 6.

Yarn length 118 is then pulled through loop 116 to form loop 120 as shown in FIG. 7. This constitutes the formation of a crochet single stitch. Yarn length 122 is then picked and pulled through loop 120 to form a second crochet single stitch as shown at 124 in FIG. 8. Yarn length 126 is then picked and pulled through loop 124 to form a third crochet single stitch as shown at 128 in FIG. 9. The end of this stitch is then used to connect the third from last loop in the chain as shown in FIG. 10. This process is repeated with the fifth from last loop and so on, repeating the steps shown in FIGS. 1–10 until the first loop in the chain is so dealt with. This completes the first crochet row. Then the needle is removed, the chain is turned around and the last stitch is manipulated to form a crochet single stitch as before. This process is continued to form the second crochet row. The needle is removed, the chain is again turned around and the third crochet row is formed. This process is continued with each additional row being connected to every single crochet in the preceding row to achieve the reversibility feature.

Four or more crochet single stitches can be used instead of the three described if desired. The pattern can be varied as desired.

The essential features of this invention common to all patterns are as follows. A crochet chain of loops has a last loop 102. A first continuation or extension of the chain passes over the periphery of loop 102 and then turns back upon itself to pass over the periphery of the loop and back out. This portion which turns back upon itself has been previously described as a picked portion of the yarn and will be referred to as a second extension. The first extension terminates in at least one crochet single stitch. The second extension terminates in at least one crochet single stitch. A third extension bearing the same relationship to the second extension as the second extension bears to the first extension can also be used and the third extension can terminate in one or more crochet single stitches before the end of this stitch is used to connect the third from last loop as described above.

While the invention has been described with particular reference to the drawings, many modifications and changes with respect thereto will be apparent to those skilled in the art and the protection sought is to be limited only by the terms of the claims which follow.

I claim:

1. An article of clothing or the like employing crocheted material, said material having a pattern, said pattern employing a chain of loops having a last loop, the last loop having a first extension which passes to the right of the loop over the periphery thereof, said first extension turning back upon itself to form a second extension, said second extension passing rearwardly under the periphery of the loop and then forwardly over the periphery of the loop to pass over the first extension.

2. The article of claim 1 wherein that portion of the second extension which passes forwardly over the loop periphery passes underneath the portion of the second extension which passes rearwardly under the loop periphery.

3. The article of claim 2 wherein the article is reversible.

4. The article of claim 3 wherein at least one crochet single stitch is formed at the end of the first extension before the first extension is turned back upon itself and at least one crochet single stitch is formed at the end of the second extension.

5. The article of claim 4 wherein the strand has a third extension bearing the same relationship to the second extension as the second extension bears to the first extension.

6. The article of claim 5 wherein at least one crochet single stitch is formed at the end of the third extension.

7. The article of claim 5 wherein each crochet row is connected to every single crochet of the previous row.

* * * * *